US005344154A

United States Patent [19]

Langstroth

[11] Patent Number: 5,344,154

[45] Date of Patent: Sep. 6, 1994

[54] BOARD GAME WITH TRAP DOORS

[76] Inventor: Steven W. Langstroth, 500 S. Carmichael Ave. #332 D, Sierra Vista, Ariz. 85635

[21] Appl. No.: 129,347

[22] Filed: Sep. 30, 1993

[51] Int. Cl.[5] ..... A63F 3/02

[52] U.S. Cl. ..... 273/287; 273/260

[58] Field of Search ..... 273/287, 281, 260, 237

[56] References Cited

U.S. PATENT DOCUMENTS

| | | | |
|---|---|---|---|
| 919,148 | 4/1909 | Flint et al. | 273/287 |
| 2,463,425 | 3/1949 | Rendel | 273/260 |
| 2,684,247 | 7/1954 | De Bella | 273/260 |

*Primary Examiner*—Benjamin H. Layno
*Attorney, Agent, or Firm*—Cahill, Sutton & Thomas

[57] ABSTRACT

A board game includes an enclosure having a playing surface containing a plurality of squares in an array, wherein each of said squares is a trap door. The squares on each half of a centerline across the surface are controlled by control panels on opposite sides of the enclosure. Each control panel has a plurality of switch mechanisms connected one each to a square for moving the square out of the plane of the playing surface. The switch mechanisms are actuated by removable buttons fitting within an array of holes in the control panel. The array of holes corresponds to the array of squares on one half of the playing surface. Not all of the holes receive buttons, i.e. the number and location of the buttons is determined by the rules for play, and the buttons can be arranged asymmetrically with respect to the centerline.

10 Claims, 3 Drawing Sheets

BOARD GAME WITH TRAP DOORS

BACKGROUND OF THE INVENTION

This invention relates to board games and, in particular, to a checkerboard in which an array of trap doors occupies the field of play and a predetermined sub-set of the trap doors can be activated.

A checkerboard has long provided a versatile background for a variety of games of different strategies, e.g. from the elimination strategy of checkers played in its simplest form to the exhausting tactics and territorial control of chess. For these and many other games, the venerable checkerboard has provided a simple and versatile field of play.

Despite the versatility of a checkerboard, attempts have been made to provide additional features. U.S. Pat. No. 2,684,247—De Bella—discloses a 10×10 checkerboard in which eight of the twenty squares adjacent the centerline between players include a trapdoor for eliminating an opponent's piece. Four trapdoors are actuated individually by each player and include an arm for sweeping in a piece from a square adjoining the square with a trap door. While providing a variant way of eliminating an opponent's pieces, the trapdoors and arms encumber the board when playing without their use and provide only a limited amount of surprise. Further, it is possible to cross the field of play without encountering a trapdoor or an arm.

In view of the foregoing, it is therefore an object of the invention to provide a random number of trapdoors in a board game.

Another object of the invention is to provide a board game in which each square in a checkerboard includes a trap door but not all of the trapdoors in each half of the board are used.

A further object of the invention is to provide a board game including trapdoors in which the location of the active trap doors is determined by each player prior to play.

Another object of the invention is to provide a board game in which a plurality of trap doors can be arranged asymmetrically relative to a centerline between the players.

SUMMARY OF THE INVENTION

The foregoing objects are achieved in the invention in which a board game includes a plurality of squares in an array in a single plane, wherein said squares collectively forming a playing surface and each of said squares is a trap door through said surface. The squares are supported by an enclosure having the squares as one major surface of the enclosure. The squares on each half of a centerline are controlled by control panels on opposite sides of the enclosure. Each control panel has a plurality of switch mechanisms connected one each to a square for moving the square out of the plane of the playing surface. The switch mechanisms are actuated by removable buttons fitting within an array of holes in the control panel. The array of holes corresponds to the array of squares on one half of the playing surface. Not all of the holes receive buttons, i.e. the number and location of the buttons is determined by the rules for play, and the buttons can be arranged asymmetrically with respect to the centerline.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
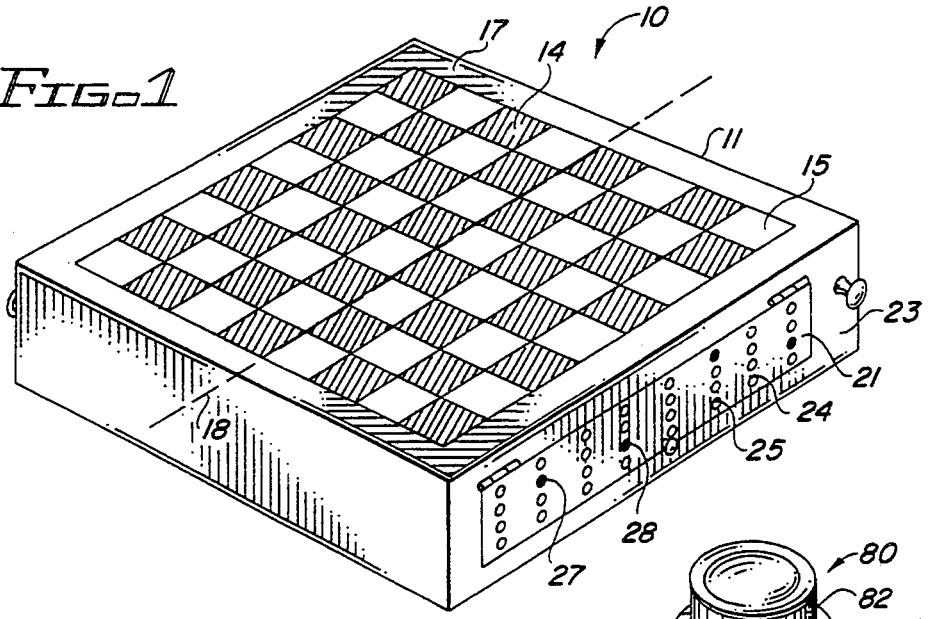
FIG. 1 illustrates a board game constructed in accordance with the invention in which a control panel for the trap doors is vertical.

In FIG. 1, board game 10 includes enclosure 11 having a major surface on which a plurality of squares are in an array in a single plane. Each of the squares, such as squares 14 and 15, is a trap door hinged to swing out of the plane of major surface 17 into the interior of enclosure 11 under the control of one of the players. The squares are held in the plane of major surfaces 17 by springs (not shown in FIG. 1). In a preferred embodiment of the invention, the playing surface includes sixty-four squares arranged in an eight by eight array with each player controlling the thirty-two squares on his side of center line 18.

Control of the squares on each side of center line 18 is divided between control panels on opposite sides of enclosure 11. Control panel 21 in side 23 includes a plurality of holes such as holes 24 and 25, in an array corresponding to the squares on one side of center line 18. A predetermined number of holes, such as holes 27 and 28, include a button for actuating a trap door mechanism connected to the corresponding square. For example, button 27 controls the trap door mechanism for square 31 underneath piece 32.

The number and location of the buttons is determined by each player prior to commencing play in accordance with the rules for play. The buttons can be removed and rearranged when the control panel is open. Each control panel is held in place by a latch, and the release for the latch is on the opponent's side of the board. Prior to play, each player unlocks his opponent's panel and the opponent lifts his panel by way of knob 33 to obtain access to the buttons. The structure underneath the control panel is more fully described in connection with FIG. 3.

Figure 2:
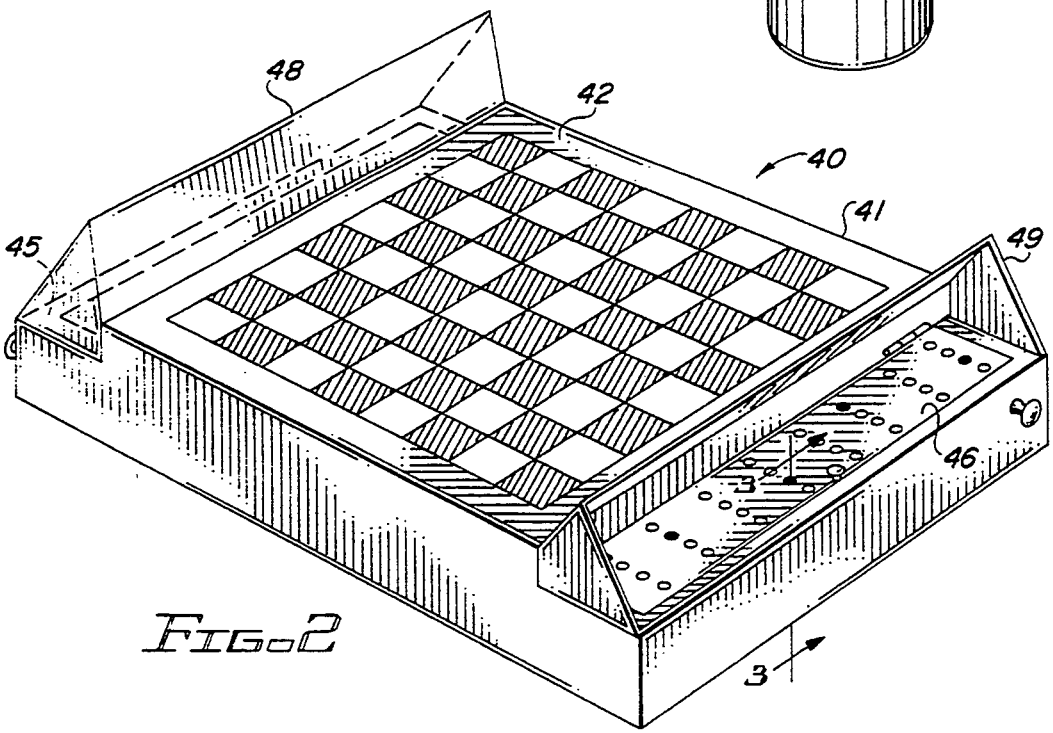
FIG. 2 illustrates a board game constructed in accordance with the invention in which a control panel for the trap doors is horizontal.

FIG. 2 illustrates an alterative embodiment of the invention in which the control panels are horizontal. In FIG. 2, board game 40 includes enclosure 41 having major surface 42 containing a plurality of squares in an array forming a playing surface. In this embodiment, control panels 45 and 46 are parallel to major surface 42 but displaced therefrom to provide some security from being seen by an opponent and to protect the secrecy of the location of the buttons actuating particular trap doors. Secrecy is further enhanced by the addition of screens 48 and 49 for obscuring the view of control panels 45 and 48. Screens 48 and 49 can be opaque or a translucent, tinted plastic.

Figures 3, 5:
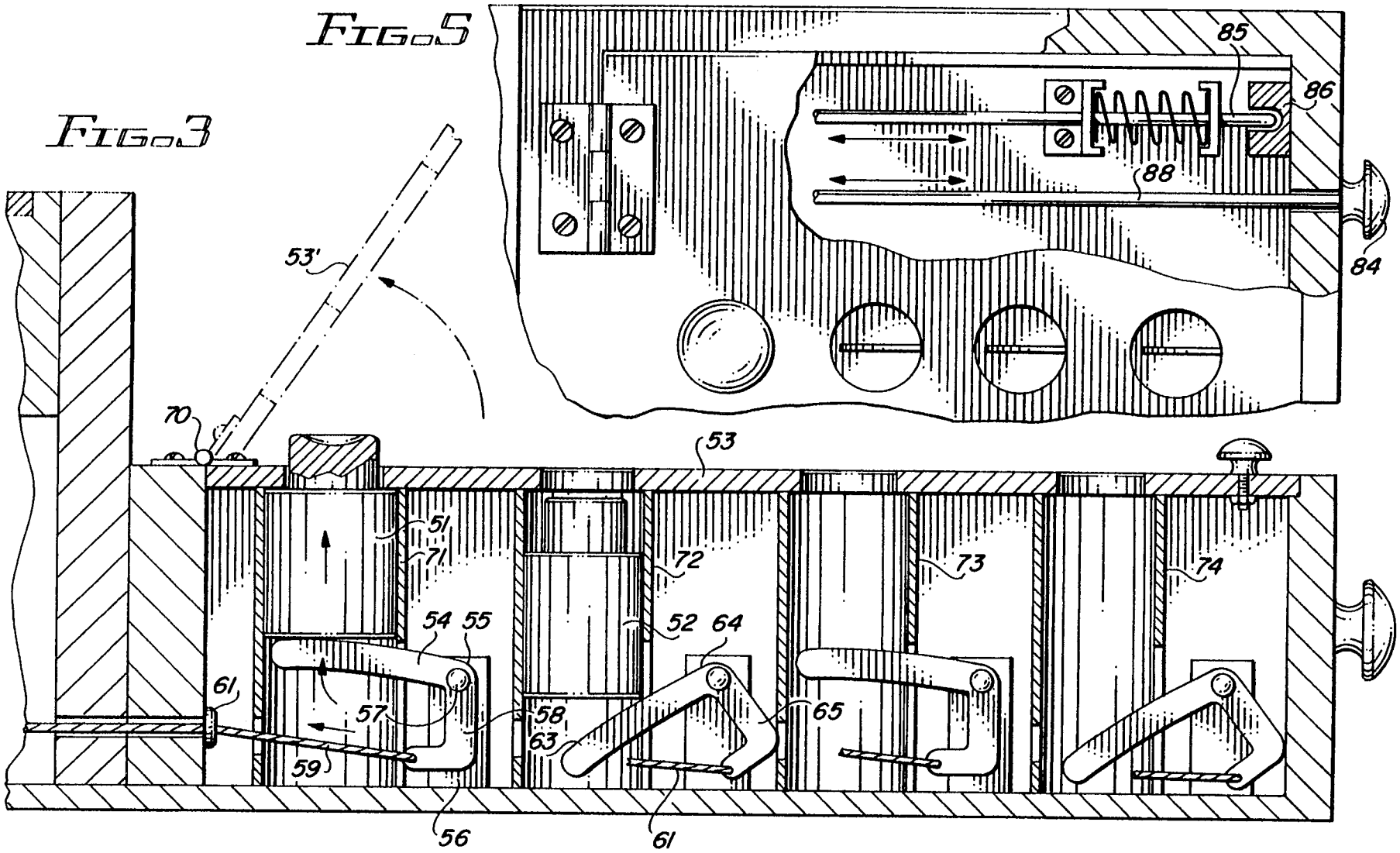
FIG. 3 is a cross-section along line 3—3 in FIG. 2.
FIG. 5 is a cut-away view of a portion of the control panel shown in FIG. 5.

FIG. 3 illustrates a portion of the mechanism by which the buttons actuate the trap doors. In FIG. 3, button 51 is in a raised position, corresponding to a closed trap door, and button 52 is in a lowered position corresponding to an open trap door. Button 51 rests on arm 54 of lever 55. Lever 55 is attached to support 56 by screw 57 and pivots about the screw. Arm 58 of lever 55 is attached to cable 59 which passes through grommet 61 and extends to a trap door mechanism illustrated in FIG. 6. Springs adjacent the trap doors keep the trap doors closed and the buttons raised.

In FIG. 3, button 52 has been depressed, pushing down on arm 63 of lever 64. Arm 65 of lever 64 is rotated counter-clockwise, increasing the tension on cable 67, thereby actuating the trap door connected to cable 67.

The number and position of the buttons is determined by each player prior to commencing play. Control panel 53 is attached to the enclosure by hinge 70. Prior to play, control panel 53 is raised to position 53' revealing an array of tubes, such as tubes 71–74. Buttons are placed in some of the tubes and the panel is closed. The number of buttons determined by the rules of play and the location of the buttons is determined by each player.

Figure 4:
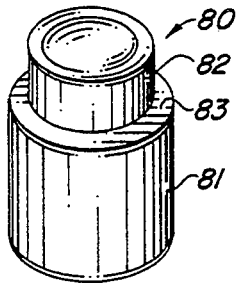
FIG. 4 illustrates a button for springing a trap door.

FIG. 4 illustrates one of the buttons used for actuating a trap door. Button 80 includes cylindrical body 81 and neck 82 having a smaller diameter than the body. Body 81 and neck 82 are connected by shoulder 83 which engages the underside of the control panel. Neck 82 is slightly smaller than the holes in the control panel and body 81 is slightly larger than the holes in the control panel. The buttons are inserted into the tubes and the control panel is lowered into place, covering the bodies of the buttons but permitting the necks of the buttons to protrude through the holes in the control panel. The control panel is locked in place with the release under the control of the opponent.

FIG. 5 illustrates a latch release mechanism constructed in accordance with the invention in which pin 85 is inserted into socket 86 on one player's side of the board game. Release knob 84 is connected by cable 88 to a pin on the opposite side of the enclosure. Once play commences, each player is prevented from changing the location of the activated trap doors.

Figure 6:
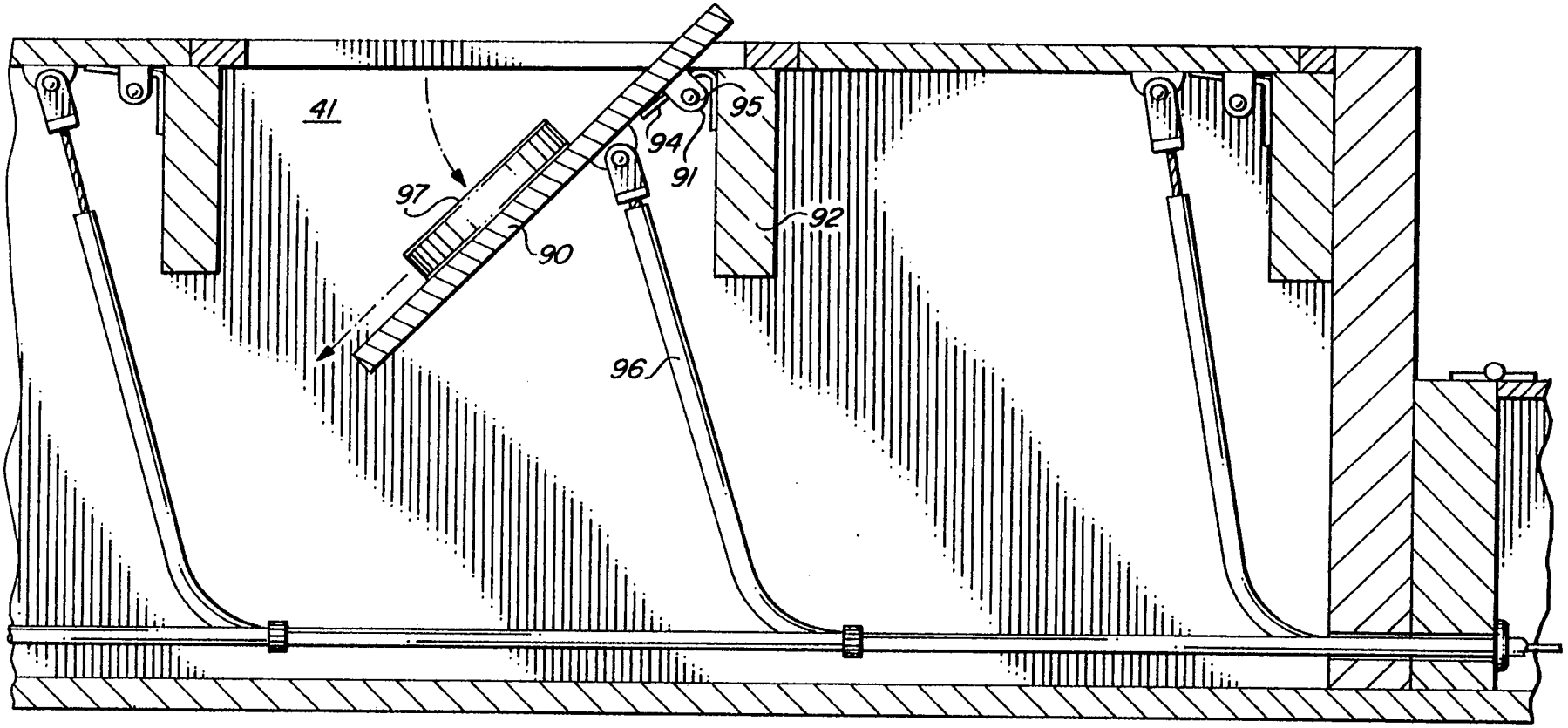
FIG. 6 is a cross-section of a portion of the board, showing the trap door release mechanism

FIG. 6 illustrates the construction of the trap doors in which square 90 is attached by hinge 91 to support 92. Spring 94 on hinge 91 holds square 90 in the plane of the upper major surface of the enclosure. Spring 94 is wound on a portion of pin 95 of hinge 91. When the button corresponding to square 90 is pushed, cable 96 pulls square 90 down out of the plane of the playing surface, permitting piece 97 to slide into the interior of enclosure 41.

Thus the invention provides a board game having a random number of active trap doors in which each square of the board game includes a trap door but not all of the trap doors are active. In addition, the arrangement of the active trap doors is determined by each player prior to play and need not be symmetrical with respect to a center line between the players. The addition of the trap doors thus adds an element of bluff and surprise to the board game. Some general rules that could apply to any game played on the board include 1) springing a trap door counts as a turn, even if the square is unoccupied, 2) a trap door can be sprung no more than a predetermined number of times, 3) a trap door need not be sprung even though an opponent's piece occupies the square, and 4) a trap door may not be sprung on consecutive turns.

In checkers for example, four trap doors are activated on each side of the centerline. Since only the light squares are used for checkers, each player has one chance in four of having a trap door sprung on one of his pieces. If desired, the active trap doors can be in a row across the board, preventing an opponent's piece from crossing the board. Alternatively, the trap doors can be used to protect the back or king's row or the squares protecting the right-hand corner square, which is often a trap.

For chess, four trap doors are activated on each side of the centerline. Since all sixty-four squares are used for chess, each player has one chance in eight of having a trap door sprung on a piece. Since the odds are lower, one must exercise greater skill in choosing the squares to activate. One could activate the trap doors at the center squares to assist the opening game or early middle game or one could activate trap doors in the back two rows to protect the king after castling, thereby augmenting the end game. One could permit a draw by what amounts to suicide for the king, a player springing the trap on his own king if the fatal square is not under check. This option can be made more difficult by requiring that the king sojourn to the opponent's side of the board for at least one turn before returning to meet his fate. As shown by these examples, a checkerboard constructed in accordance with the invention provides strategic and tactical options not available in the prior art.

Having thus described the invention, it will be apparent to those of skill in the art that various modifications can be made within the scope of the invention. For example, instead of springs biasing the trap doors closed, the springs can bias the trap doors open. In this case, each button actuates a release, similar to the release for the control panel, to open the trap door. This configuration has the advantage of a more rigid playing surface but is more difficult to set up and removes a square from the field of play once a trap door is sprung. The trap doors can be electronically actuated by solenoids rather than being mechanically actuated but this requires a source of electrical energy such as batteries. There are variations of the rules that players may prefer. For example, one could provide that the trap doors collectively can be sprung no more than a predetermined number of times, i.e. one can spring one trap door eight times or four trap doors two times each or any combination totalling eight. The board game can be implemented in software representing the board, playing pieces, and control panels metaphorically on a video screen and operating in accordance with rules for play as described above.

I claim:

1. A board game comprising:

(a) a plurality of squares in an array in a single plane, wherein said squares collectively form a playing surface and each of said squares is a trap door through said surface;

(b) an enclosure supporting said squares and having said playing surface as a major surface of said enclosure;

(c) first and second control panels on opposite sides of said enclosure, said first and second control panels having (i) a plurality of switch mechanisms connected one each to a square for moving the square out of said plane;

(ii) a plurality of holes in an array corresponding to said squares in said playing surface wherein said plurality of switch mechanisms are situated one to each hole; and (iii) a plurality of removable buttons fitting within said holes for actuating some of said switch mechanisms, the number and placement of said buttons being determined by a set of rules for play in which pieces are moved on said squares.

2. The board game as set forth in claim 1 wherein each of said switch mechanisms includes a crank having a first arm and a second arm connected by a pivot, wherein said first arm receives one of said buttons and the second arm is coupled to one of said squares.

3. The board game as set forth in claim 1 wherein each of said control panels include a latch for holding said control panels in place and a release for unlatching the control panel on the opposite side of said enclosure.

4. The board game as set forth in claim 1 wherein each of said squares is held in said plane by a spring connecting the square to said enclosure.

5. The board game as set forth in claim 1 wherein each of said buttons comprises:

a cylindrical body having a predetermined diameter and a neck having a smaller diameter than said cylindrical body, wherein said neck fits through the holes in said control panels.

6. The board game as set forth in claim 1 wherein said enclosure includes vertical sides and said control panels are attached to said vertical sides.

7. The board game as set forth in claim 1 wherein said control panels are horizontal and in a different plane from said playing surface.

8. The board game as set forth in claim 1 and further comprising:

a first screen positioned adjacent said first control panel and a second screen positioned adjacent said second control panel, said first screen and said second screen obscuring an opponent's view of the control panel.

9. A game comprising:

a plurality of squares in an array in a single plane wherein said squares collectively form a playing field and each of said squares is a trap door;

a first control panel and a second control panel, each control panel having a plurality of holes in an array corresponding to the squares in respective halves of said playing field;

a plurality of switch mechanisms connected one to each square for moving the square out of said plane, wherein said plurality of switch mechanisms are situated one to each hole; and a plurality of removable buttons located in some of said holes in each control panel for actuating some of said switch mechanisms, the number and placement of said buttons being determined by a set of rules for play in which pieces are moved on said squares.

10. The game as set forth in claim 9 wherein said buttons are located in said first control panel independently of the location of the buttons in said second control panel.

* * * * *